US008291999B2

(12) United States Patent
Howson et al.

(10) Patent No.: US 8,291,999 B2
(45) Date of Patent: Oct. 23, 2012

(54) CONTROL ARRANGEMENT FOR MOTOR GRADER BLADE

(75) Inventors: Brian Howson, Peoria, IL (US); Thomas E. Oertley, Peoria, IL (US); Christopher A. Junck, East Peoria, IL (US); Chris Zach, San Diego, CA (US)

(73) Assignee: Caterpillar Inc., Peoria, IL (US)

( * ) Notice: Subject to any disclaimer, the term of this patent is extended or adjusted under 35 U.S.C. 154(b) by 319 days.

(21) Appl. No.: 12/345,786

(22) Filed: Dec. 30, 2008

(65) Prior Publication Data

US 2010/0163259 A1 Jul. 1, 2010

(51) Int. Cl.
*E02F 3/00* (2006.01)

(52) U.S. Cl. ..... 172/796

(58) Field of Classification Search ..... 172/791, 172/792, 796

See application file for complete search history.

(56) References Cited

U.S. PATENT DOCUMENTS

| | | | | |
|---|---|---|---|---|
| 1,844,058 | A | 2/1932 | Dean | |
| 2,195,607 | A | 4/1940 | Wilson et al. | |
| 2,238,389 | A | 4/1941 | Kerber | |
| 2,811,139 | A * | 10/1957 | Lado | 91/176 |
| 2,928,381 | A * | 3/1960 | Macdonald | 91/186 |
| 2,959,876 | A | 11/1960 | Lull | |
| 3,028,699 | A | 4/1962 | Greeley | |
| 3,381,760 | A | 5/1968 | Braud | |
| 3,512,589 | A * | 5/1970 | Ulrich | 172/786 |
| 3,721,303 | A | 3/1973 | Hanser | |
| 3,739,861 | A * | 6/1973 | Johnson et al. | 172/793 |
| 4,053,016 | A * | 10/1977 | Stedman | 172/1 |
| 4,071,090 | A * | 1/1978 | Easterling | 172/788 |
| 4,074,768 | A | 2/1978 | Steadman | |
| 4,161,987 | A | 7/1979 | Tolmer | |
| 4,258,797 | A | 3/1981 | McKenzie et al. | |
| 4,279,312 | A * | 7/1981 | Pyle | 172/789 |
| 4,340,119 | A | 7/1982 | MacDonald | |
| 5,782,016 | A | 7/1998 | Feller et al. | |
| 6,152,237 | A | 11/2000 | Hartman et al. | |
| 6,758,286 | B2 * | 7/2004 | Walker | 172/795 |

* cited by examiner

*Primary Examiner* — Thomas B Will
*Assistant Examiner* — Joel F. Mitchell
(74) *Attorney, Agent, or Firm* — Leydig, Voit & Mayer

(57) ABSTRACT

Mounting arrangement includes a drawbar assembly universally coupled to a longitudinally extending front frame portion of a machine proximal to a front wheel and a distance rearward from the wheel. An implement mounting bracket pivotably coupled to the assembly defines an articulation axis. First and second hydraulic actuators advance respective power links coupled to the mounting bracket to rotate the mounting bracket about the articulation axis. Respective idler links limit the movement of the actuators and power links.

20 Claims, 9 Drawing Sheets

CONTROL ARRANGEMENT FOR MOTOR GRADER BLADE

TECHNICAL FIELD

This patent disclosure relates generally to motor graders, and, more particularly to a control arrangement for a blade for a motor grader.

BACKGROUND

Motor graders are used primarily as finishing tools to sculpt a surface of terrain to a final arrangement. Rather than moving large quantities of earth in the direction of travel like other machines, such as a bulldozer, a motor grader typically moves relatively small quantities of earth from side to side. In other words, a motor grader typically moves earth across the area being graded, rather than straight ahead.

Conventional motor graders typically include a frame supported on spaced front and rear wheels, with a blade or mold board suspended below the frame between the front and rear wheels in a pulled arrangement. In order to allow the motor grader to move earth in a desired manner, the blade is adjustable in multiple dimensions. Generally, the blade is supported on a circle that is coupled to a drawbar suspended by struts below the frame between the front and rear wheels. The circle is mechanically engaged with the drawbar by a gearing mechanism. A hydraulic motor is disposed to rotate the circle relative to the drawbar in order to pivot the blade about an articulation axis.

The components of the rotation mechanism, including, for example, the worm gear drive and ring gear typically utilized to rotate the blade relative to the drawbar, as well as wear plates, may necessitate ongoing maintenance, particularly in view of their exposure to weather elements, as well dirt, gravel and the like from the surrounding terrain. Further, the rotation mechanism may present packaging challenges, and may limit degrees of movement. Additionally, the rotation mechanism may require specialized components, such as rotary hydraulic elements.

U.S. Pat. No. 4,074,768, which is likewise assigned to the assignee of this disclosure, is directed to a mechanism that alleviates some of these potential shortcomings by utilizing a blade support and control arrangement that includes a linkage arrangement that pushes, as opposed to pulls the blade. The arrangement disclosed in the '768 patent presents its own shortcomings, however, and may be unstable in some applications.

As a result, it is desirable to provide a blade mounting arrangement that eliminates or minimizes potential difficulties with existing systems.

SUMMARY

The disclosure describes, in one aspect, a mounting arrangement for coupling an implement to a machine. The machine includes a longitudinally extending mainframe having a rear frame portion and a front frame portion. The rear frame portion is supported on a plurality of rear ground-engaging members, while the front frame portion extends forwardly from the rear frame portion and is at least partially supported on at least one front ground-engaging member. The mounting arrangement comprises a drawbar assembly, a mounting bracket coupled to the drawbar assembly to pivot about an articulation axis, first and second idler links, first and second power links, and first and second hydraulic actuators. The drawbar assembly has rearward and forward ends. The forward end is adapted to be universally coupled to the front frame portion proximal to the at least one front ground engaging member, and the rearward end is adapted to be coupled to the front frame member a distance from the at least one front ground engaging member. The first and second idler links each have first and second ends, the first end of each idler link being pivotably coupled to the drawbar assembly. The first and second power links each have first and second ends, the first ends of the power links being pivotably coupled to the mounting bracket at the first and second spaced bracket connections, which are spaced from the articulation axis. The first and second hydraulic actuators each have first and second sections adapted to telescope between extended and retracted positions. The first section of each hydraulic actuator is coupled to the drawbar assembly. The second section of the first hydraulic actuator is pivotably coupled to the second end of the first power link and the second end of the first idler link, while the second section of the second hydraulic actuator is pivotably coupled to the second end of the second power link and the second end of the second idler link.

The disclosure describes, in another aspect, a machine adapted to support an implement. The machine comprises a mainframe having rear and front frame portions. The front frame portion is elongated and extends forwardly from the rear frame portion. The rear frame portion is supported on a plurality of rear ground-engaging members. The front frame portion is at least partially supported on at least one front ground-engaging member. A drawbar assembly having rearward and forward ends is disposed below a portion of the front frame portion. The forward end is universally coupled to the front frame portion proximal to the at least one front ground engaging member, while the rearward end is coupled to the front frame member a distance from the at least one front ground engaging member. A mounting bracket is pivotably coupled to the drawbar assembly and defines an articulation axis. First and second idler links each include first and second ends. The first end of each idler link is pivotably coupled to the drawbar assembly. First and second power links each have first and second ends. The first ends of the power links are pivotably coupled to the mounting bracket at first and second spaced bracket connections, which are spaced from the articulation axis. First and second hydraulic actuators each have first and second sections adapted to telescope between extended and retracted positions. The first section of each hydraulic actuator is coupled to the drawbar assembly. The second section of the first hydraulic actuator is pivotably coupled to the second end of the first power link and the second end of the first idler link, while the second section of the second hydraulic actuator is pivotably coupled to the second end of the second power link and the second end of the second idler link.

The disclosure describes, in another aspect, a motor grader adapted to support a blade. The motor grader comprises a mainframe having a rear and front frame portions, the front frame portion being elongated and extending forwardly from the rear frame portion. The rear frame portion is supported on a plurality of rear ground-engaging members. The front frame portion is at least partially supported on at least one front ground-engaging member. A drawbar assembly is disposed below a portion of the front frame portion. The drawbar assembly has rearward and forward ends. The forward end is universally coupled to the front frame portion proximal to the at least one front ground engaging member. The rearward end is coupled to the front frame member a distance from the at least one front ground engaging member. A mounting bracket to which the blade is coupled is pivotably coupled to the drawbar assembly and defines an articulation axis. First and second idler links each have first and second ends. The first end of each idler link is pivotably coupled to the drawbar assembly. First and second power links each have first and second ends. The first ends of the power links are pivotably coupled to the mounting bracket at first and second spaced bracket connections, which are disposed on opposite sides of a plane including the articulation axis. First and second double acting hydraulic actuators each have first and second sections adapted to telescope between extended and retracted positions. The first section of each hydraulic actuator is coupled to the drawbar assembly. The second section of the first hydraulic actuator is pivotably coupled to the second end of the first power link and the second end of the first idler link, while the second section of the second hydraulic actuator is pivotably coupled to the second end of the second power link and the second end of the second idler link.

BRIEF DESCRIPTION OF THE DRAWING(S)

DETAILED DESCRIPTION

Figure 1:
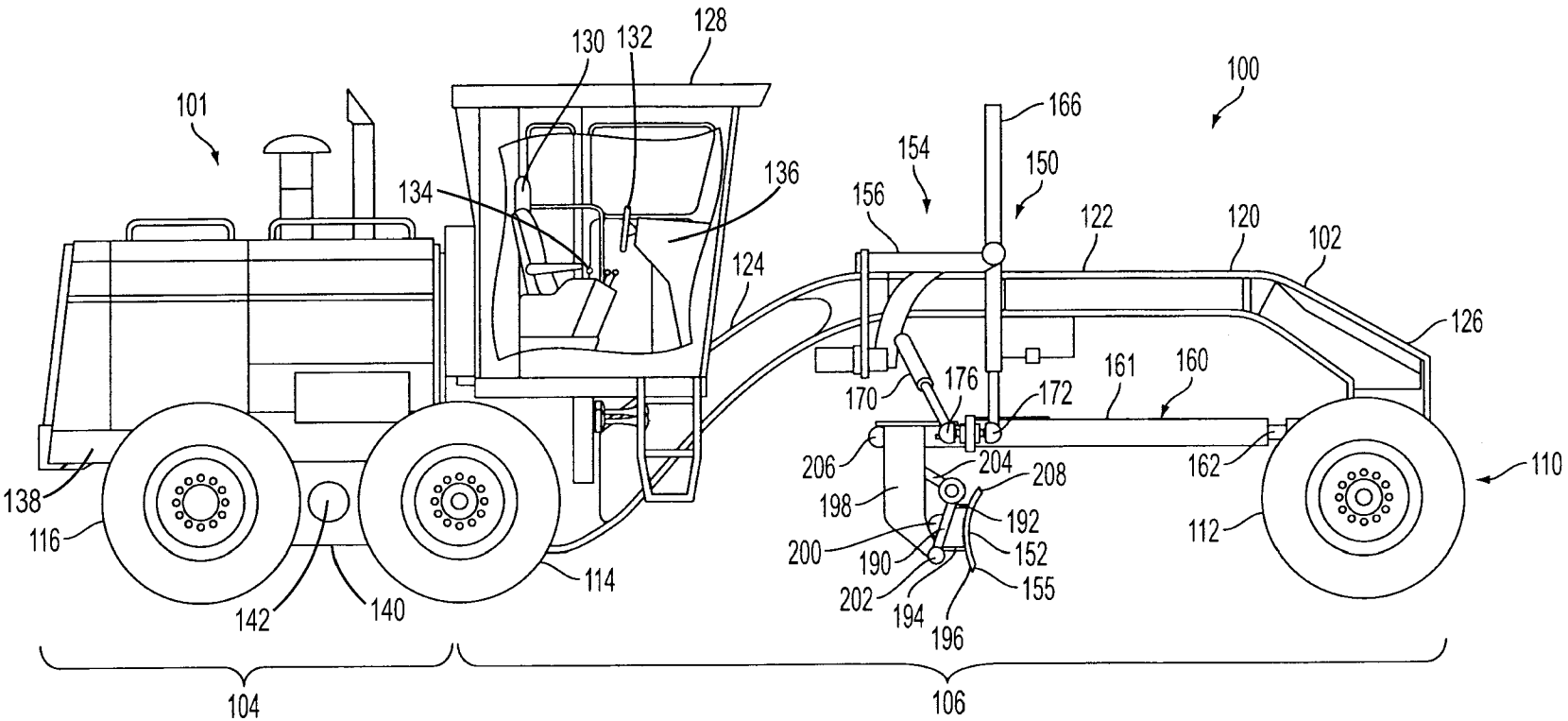
FIG. 1 is a side elevational view of a motor grader according to aspects of the disclosure.
Figure 2:
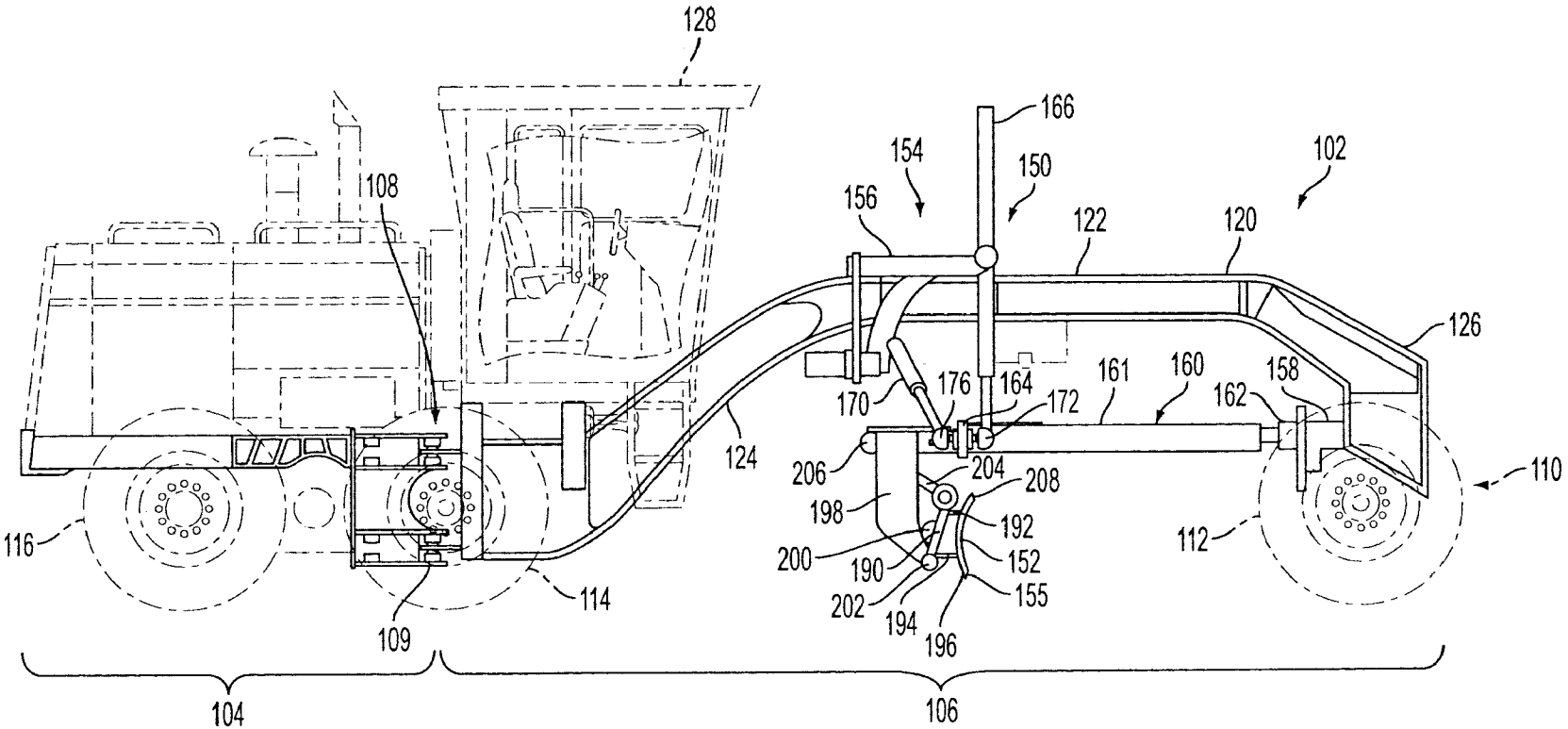
FIG. 2 is side elevational view of the mainframe and blade attachment of the motor grader of FIG. 1, other features of the motor grader being illustrated in phantom.

This disclosure relates to a mounting arrangement for coupling an implement to a machine 100, such as a motor grader 101 illustrated in FIG. 1. The motor grader 101 includes a mainframe 102. Although the mainframe 102 may be a single structure, in the illustrated embodiment, the mainframe 102 includes a rear frame portion 104 and a front frame portion 106. The rear and front frame portions 104, 106 may optionally be articulated at an articulated joint 108, which includes a hinge (shown generally as 109). The mainframe 102 is supported on a plurality of ground engaging members 110. In the illustrated embodiment, the ground engaging members 110 include a pair of front wheels 112, which are spaced from a plurality of rear wheels 114, 116, which are disposed in pairs along opposite sides of the rear frame portion 104. It will be appreciated, however, that the ground engaging members 110 may include alternate arrangements, such as, for example, a pair of front wheels 112 and a single pair of rear wheels, or the rear wheels 114, 116 may alternately be track assemblies, as are known in the art.

The front frame portion 106 includes a front frame section 120 supported between the hinge 109 and forward ground engaging members 110, here, the illustrated pair of front wheels 112. The front frame section 120 includes a generally longitudinally extending portion 122, a rearward, generally descending portion 124, and a forward, generally descending portion 126. The front frame section 120 is supported by the hinge 109 at the rearward end of the generally descending portion 124. The front frame section 120 is supported by the front wheels 112 at the forward end of the generally descending portion 124.

An operator cab 128 may be supported along the front frame section 120. The cab 128 may include, for example, a seat 130, a steering mechanism 132, a speed-throttle or control lever 134, and a console 136. An operator occupying the cab 128 can control the various functions and motion of the motor grader 101, for example, by using the steering mechanism 132 to set a direction of travel for the motor grader 101, or by using the control lever 134 to set the travel speed of the machine 100. As can be appreciated, the representations of the various control mechanisms presented herein are generic and are meant to encompass all possible mechanisms or devices used to convey an operator's commands to a machine, including, for example, so-called joystick operation. While an operator cab 128 is shown in the illustrated embodiments, the inclusion of such a cab 128 and associated seat 130, control mechanisms 132, 134 and console 136 are optional in that the machine 100 could alternately be autonomous, that is, the machine 100 may be controlled by a control system that does not require operation by an on-board human operator.

The rear frame portion 104 includes a rear frame section 138 that is supported on the plurality of ground engaging members 110 along either side of the machine 100. In the illustrated embodiment, the ground engaging members 110 supporting the rear frame section 138 include two pairs of rear wheels 114, 116. Although the ground engaging members 110 may alternately be coupled directly to the rear frame portion 104, in the illustrated embodiment, the pairs of rear wheels 114, 116 are rotatably mounted on tandem supports 140 that are themselves pivotably mounted along either side of the rear frame section 138 at pivot shafts 142. Thus, each of the rear wheels 114, 116 rotates and the tandem supports 140 pivot about respective axes 144. It will be understood by those of skill in the art that the ground engaging members 110 may include alternate or additional structure, such as, for example, belts (not shown) disposed about the pairs of rear wheels 114, 116.

For the purposes of this disclosure, the terms rear and front frame portions 104, 106 as used herein will likewise be utilized to refer generally to the forward and rearward portions of the mainframe 102 in embodiments wherein the mainframe 102 is unitary, that is, it is not articulated and does not include separate rear and front frame portions 104, 106. Similarly, the terms rear and front frame sections 138, 120 as used herein will likewise be utilized to refer generally to the forward and rearward sections of the mainframe 102 in embodiments wherein the mainframe 102 is not articulated and does not include separate rear and front frame sections 138, 120.

A blade assembly 150 is mounted along the front frame section 120 and may be utilized for grading. The blade assembly 150 includes a blade 152 and a linkage assembly (shown generally as 154) that allows the blade 152 to be moved to a variety of different positions relative to the motor grader 101. The blade 152, sometimes referred to as a moldboard, typically is used to move earth when at least a portion of the bottom cutting edge 155 of the blade 152 is in contact with the terrain below. The linkage assembly 154 allows the blade 152 to be moved to a variety of different positions relative to the motor grader 101. The linkage assembly 154 is suspended from the longitudinally extending portion 122 of the front frame section 120 at a suspended coupling 156, and coupled to the forward, generally descending portion 126 of the front frame 120 at coupling 158. Although a particular configuration of front frame section 120 is illustrated, alternate configurations may be utilized, so long as the linkage assembly 154 is suspended generally along the length of the front frame section 120 and coupled to the front frame section 120 generally forward of such suspended coupling 156.

Turning first to the forward coupling 158, the linkage assembly 154 includes a drawbar assembly 160 that is coupled to the front frame section 120 by any appropriate arrangement. In the illustrated embodiment, the drawbar assembly 160 is coupled to the front frame section 120 by a universal coupling 162, such as, for example, a ball joint assembly. A universal coupling 162 provides a degree of flexibility in the movement of the drawbar assembly 160 relative to the front frame section 120, allowing the drawbar assembly 160 to move both side to side, and upwardly and downwardly. Alternate arrangements, such as, for example, one or more hinges (not illustrated), may be utilized in place of the universal coupling 162.

The illustrated drawbar assembly 160 includes a drawbar 161 and a yolk 164. The drawbar 161 is of a V-frame design with the narrowed portion extending forward toward the attachment to the front frame section 120 at coupling 158. A generally laterally disposed yolk 164 spans the broadened end of the drawbar 161, the yolk 164 being coupled to the front frame section 120 at coupling 156, as is explained in greater detail below. Alternate arrangements may be utilized, so long as the drawbar assembly 160 extends forward toward the coupling 158 to the front frame section 120, and the combination of the drawbar 161 and the yolk 164 is suspended from the front frame section 120 at coupling 156.

The position of the yolk 164 and drawbar 161 is controlled by three hydraulic actuators, commonly referred to as a right lift actuator 166, a left lift actuator 168, and a center shift actuator 170. The coupling 156 connects the three actuators 166, 168, 170 to the front frame section 120. The actuators 166, 168, 170 are coupled to the yolk 164 by universal couplings 172, 174, 176, such as, for example, ball joint assemblies. It will be appreciated, however, that they could alternatively or additionally be coupled to the drawbar 161. Generally, the coupling 156 can be moved during blade 152 repositioning, but is fixed during earthmoving operations. The height of the blade 152 with respect to the surface of terrain below the motor grader 101, commonly referred to as blade height, is controlled primarily with the right and left lift actuators 166, 168. The right and left lift actuators 166, 168 can be controlled independently and, thus, also used to angle the bottom cutting edge 155 of the blade 152 relative to the terrain. The center shift actuator 170 is used primarily to side shift the yolk 164 and the end of the drawbar 161, and all the components mounted to the end of the drawbar 161 and the yolk 164, relative to the front frame section 120. This side shift is commonly referred to as drawbar side shift or circle center shift.

The blade 152 is coupled to the yolk 164 by way of a mounting bracket 190. The blade 152 may be coupled to the mounting bracket 190 in any appropriate manner. By way of example only, in the illustrated embodiment, a pair of longitudinally extending rails 192, 194 are disposed along a rear face 196 of the blade 152. A bracket 198 is slidably disposed along the rails 192, 194. In order to provide a controlled sliding movement of the blade 152 relative to the bracket 198, a side shift actuator 200, is coupled to the blade 152 or one of the rails 192, 194 at one end, and to the bracket 198 at the other end. As illustrated, the side shift actuator 200 is generally horizontally disposed proximal the blade 152. In this way, the extension or retraction of the side shift actuator 200 causes the blade 152 to slide along the rails 192, 194 from side to side, that is, laterally. This side-to-side shift is commonly referred to as blade side shift.

Similarly, such bracket 198 may be coupled to the mounting bracket 190 by any appropriate arrangement. Again, in the illustrated embodiment, the bracket 198 is pivotably coupled to the mounting bracket 190 at pivot points 202. In order to provide controlled pivoting of the blade 152, a blade tip actuator 204 is coupled to the bracket 198 at one end and, at the other end, to ears 206 extending from the mounting bracket 190. In this way, the extension or retraction of the blade tip actuator 204 causes the blade 152 to pitch, or pivot about an axis extending through the pivot points 202. In other words, the blade tip actuator 204 is used to tip a top edge 208 of the blade 152 ahead of or behind the bottom cutting edge 155 of the blade 152. The position of the top edge 208 of the blade 152 relative to the bottom cutting edge 155 of the blade 152 is commonly referred to as blade tip.

In order to establish a blade cutting angle, the blade 152 pivots about an axis extending normally to the yolk 164, commonly referred to as circle turn. The blade-cutting angle is defined as the angle of the blade 152 relative to the front frame section 120. At a zero degree blade-cutting angle, the blade 152 is aligned at a right angle to the front frame section 120.

Figure 3:
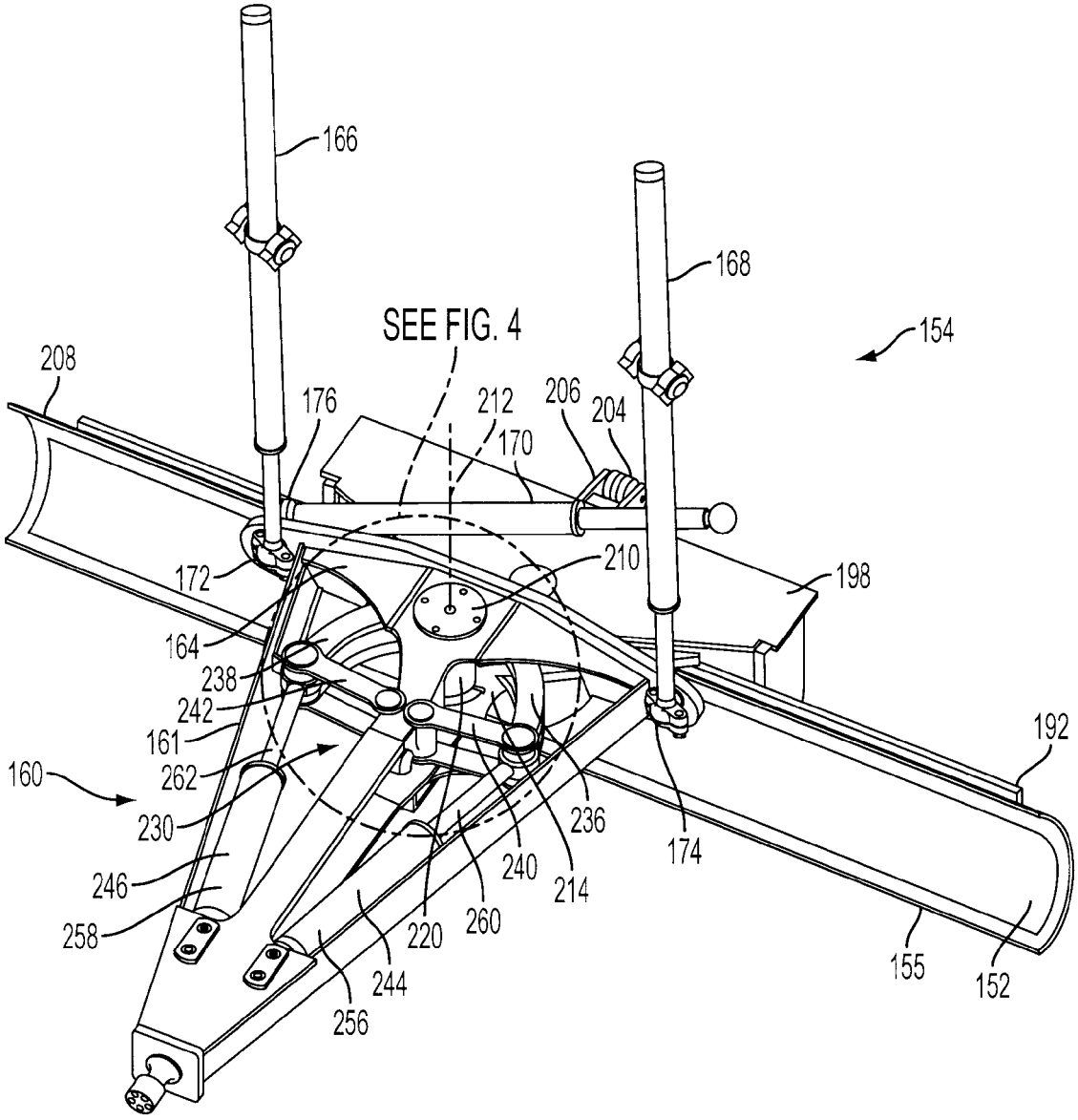
FIG. 3 is an enlarged, fragmentary isometric view of the linkage assembly of FIGS. 1 and 2.
Figure 4:
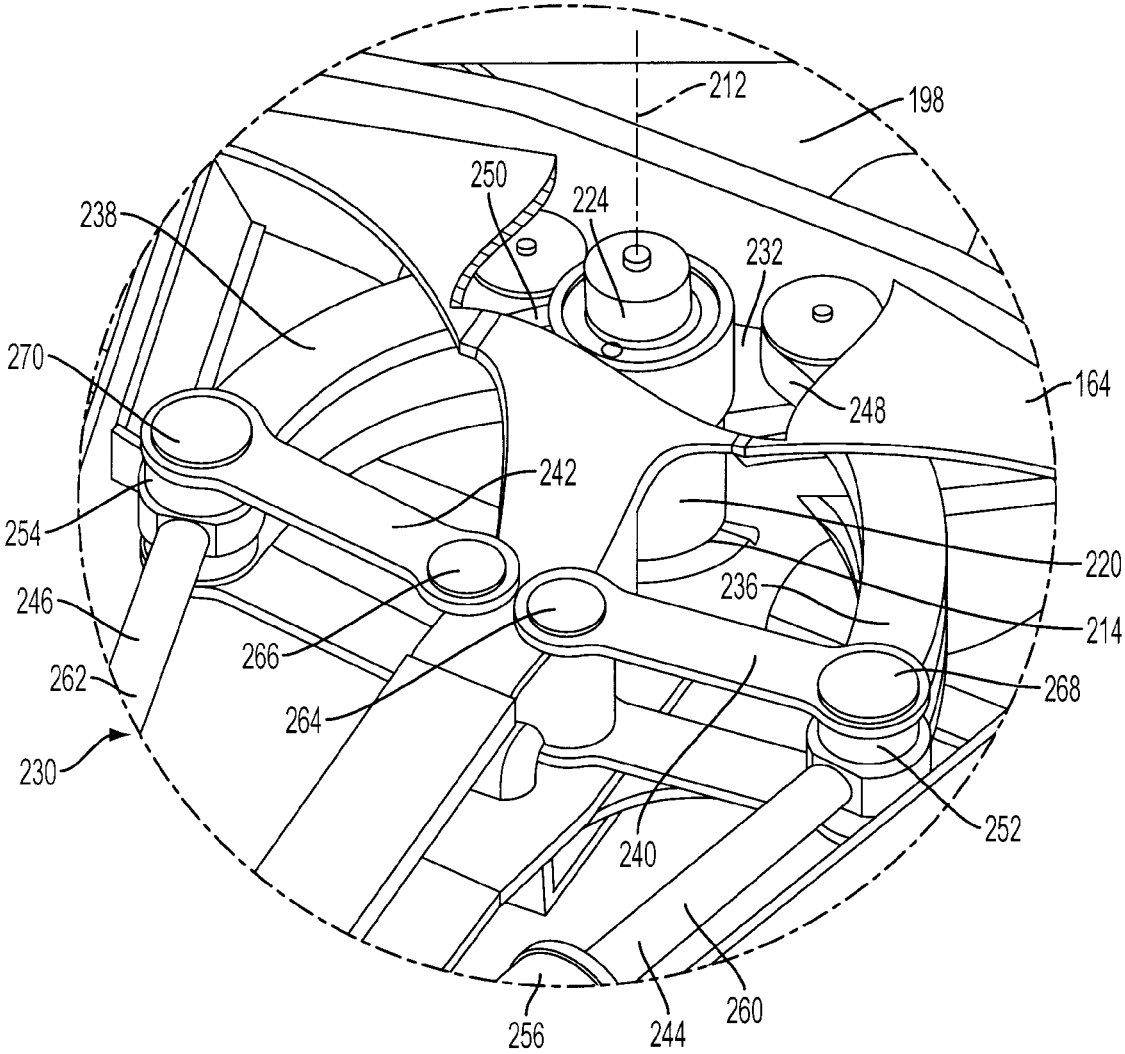
FIG. 4 is a further enlarged, fragmentary isometric view of the linkage assembly illustrated in FIG. 3.

As may best be seen in FIG. 3, the bracket 198 and yolk 164 are pivotably coupled at a rotational mounting (shown generally as 210), here, a king post mounting, defining an articulation axis 212. While any appropriate arrangement may be utilized, in the illustrated embodiment, a lower plate 214 and the yolk 164 of the drawbar assembly 160 are provided with respective openings therethrough. Similarly, the bracket 198 is provided with a sleeve 220 including a complementary opening therethrough. In an embodiment, the sleeve 220 is a casting that is welded to the bracket 198. In operation, the sleeve 220 is disposed between the yolk 164 and the lower plate 214 of the drawbar assembly 160, and a pin 224 disposed within the openings to pivotably couple the bracket 198 and the drawbar assembly 160. Those of skill in the art will appreciate that alternate arrangements may be utilized, including, by way of examples, ears extending from the bracket 198 with a sleeve of the yolk 164 disposed therebetween and a pin extending through openings in each, or a shaft coupled to the bracket 198 extending through openings in the drawbar assembly 160.

In order to allow an operator to selectively pivot the blade 152 relative to the front frame section 120, a blade angle linkage arrangement is provided (identified generally as 230). In the linkage arrangement 230 illustrated, the bracket 198 includes first and second bracket connections 232, 234 spaced from the articulation axis 212 (see FIGS. 5-6, which illustrate the linkage arrangement 230 with a portion of the yolk 164 broken away). The linkage arrangement 230 additionally includes first and second power links 236, 238, first and second idler links 240, 242, and first and second double-acting hydraulic actuators 244, 246. By way of overview, the components of the linkage arrangement 230 are coupled together such that the hydraulic actuators 244, 246 drive respective power links 236, 238 to cause the bracket 198 to pivot about the articulation axis 212, the idler links 240, 242 restraining the power links 236, 238 and the hydraulic actuators 244, 246 to result in a controlled rotation of the bracket 198.

More particularly, the first and second power links 236, 238 include first ends 248, 250 and second ends 252, 254, the first ends 248, 250 being coupled to the first and second bracket connections 232, 234, respectively. The first and second hydraulic actuators 244, 246 each include a first section 256, 258 and a second section 260, 262 that telescope relative to one another between extended and retracted positions. In the illustrated embodiment, the first sections 256, 258 are cylinder portions, while the second sections 260, 262 are rods, although alternate configurations are applicable. The first sections 256, 258 of each hydraulic actuator 244, 246 are coupled to the drawbar assembly 160, while the second sections 260, 262 are pivotably coupled to the second ends 252, 254 of the first and second power links 236, 238, respectively. Similarly, the first and second idler links 240, 242 include first ends 264, 266 and second ends 268, 270. The first ends 264, 266 of the idler links 240, 242 are pivotably coupled to the drawbar assembly 160. The second ends 268, 270 of the idler links 240, 242 are coupled to the second sections 260, 262 of the hydraulic actuators 244, 246 and the second ends 252, 254 of the first and second power links 236, 238, respectively.

In operation, in order to pivot the blade 152 to the left, hydraulic fluid is applied to the first hydraulic actuator 244 to cause the first hydraulic actuator 244 to move to a retracted position, and to the second hydraulic actuator 246 to cause the second hydraulic actuator 246 to move to an extended position. In this way, movement being limited by the first idler link 240, the first hydraulic actuator 244 retracts to exert a tensile force on the first power link 236, and, as a result, the first bracket connection 232 to cause the bracket 198 and associated blade 152 to rotate in a clockwise direction, that is, to the left. Simultaneously, movement being limited by the second idler link 242, the second hydraulic actuator 246 extend to exert a force on the second power link 238, which exerts a force at the second bracket connection 234 to cause the bracket 198 and associated blade 152 to rotate in a clockwise direction, that is, to the left.

Figure 5:
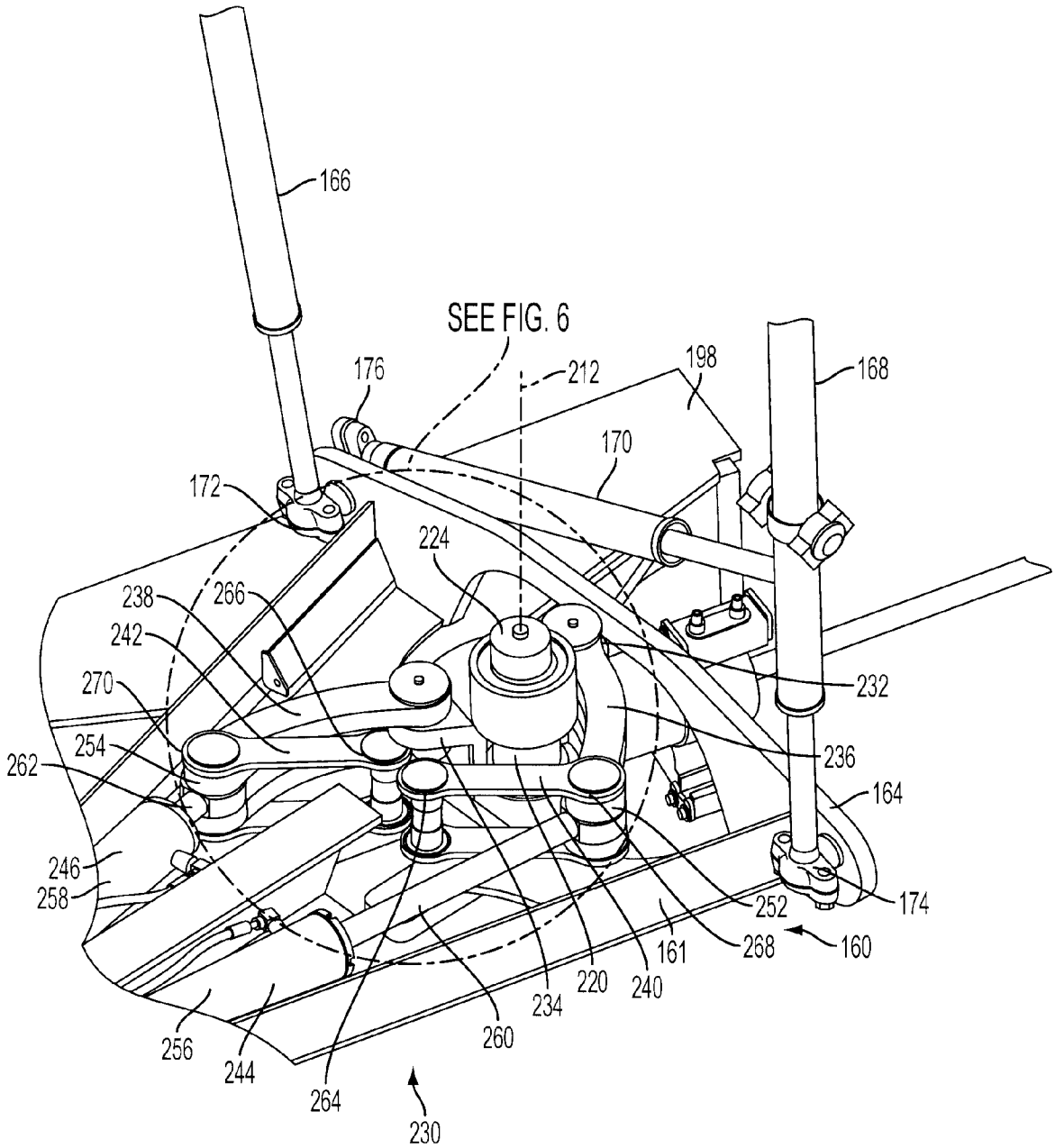
FIG. 5 is the enlarged, fragmentary isometric view of the linkage assembly of FIG. 3 partially broken away, and with the blade pivoted to the right.
Figure 6:
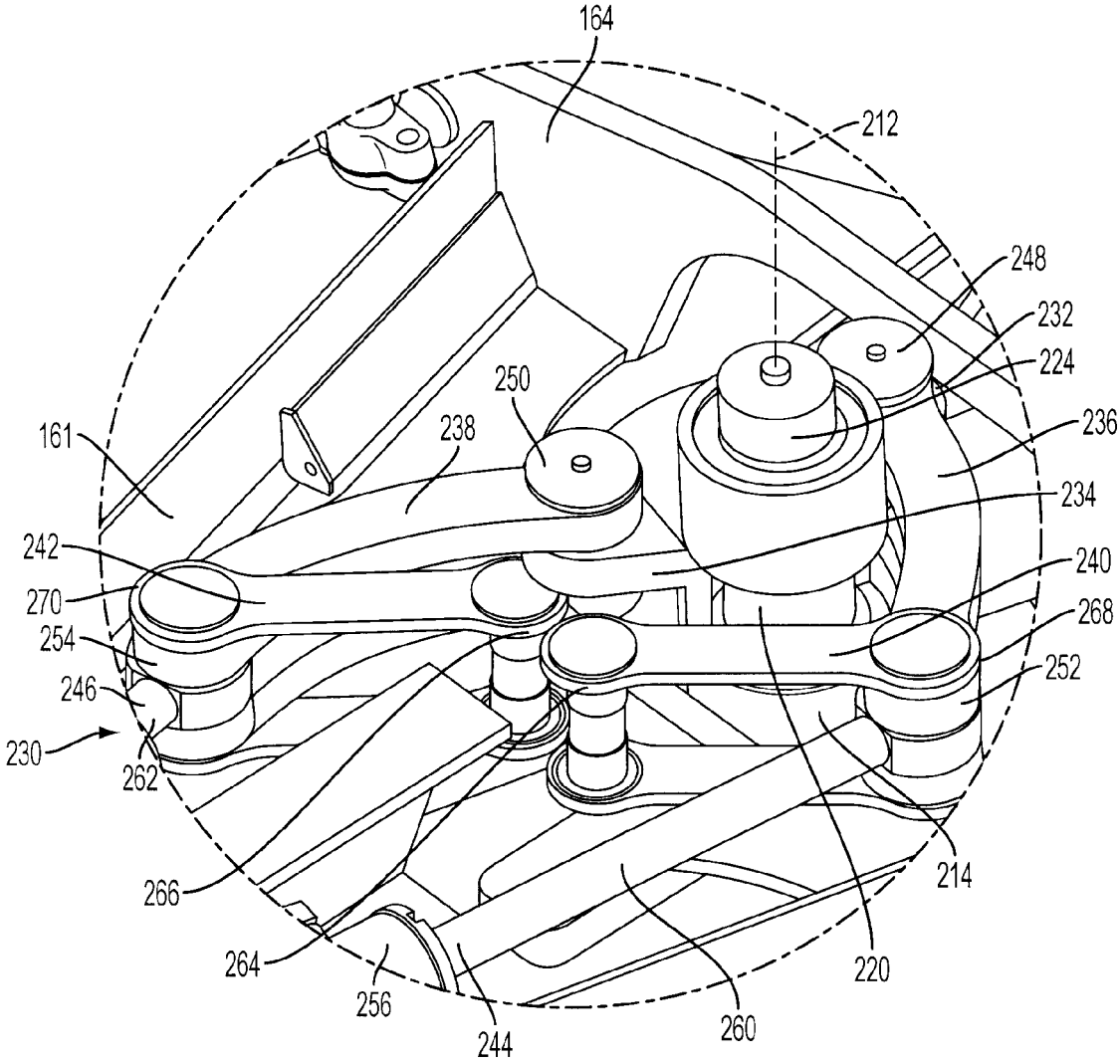
FIG. 6 is a further enlarged, fragmentary isometric view of the linkage assembly illustrated in FIG. 5.

In contrast, in order to pivot the blade 152 to the right, hydraulic fluid is applied to the first hydraulic actuator 244 to cause the first hydraulic actuator 244 to move to an extended position, and to the second hydraulic actuator 246 to cause the second hydraulic actuator 246 to move to a retracted position, as illustrated in FIGS. 5-6. In this way, movement being limited by the first idler link 240, the first hydraulic actuator 244 extends to advance the first power link 236 to exert a force at the first bracket connection 232 to cause the bracket 198 and associated blade 152 to rotate in a counterclockwise direction, that is, to the right. Simultaneously, movement being limited by the second idler link 242, the second hydraulic actuator 246 retracts to exert a tensile force on the second power link 238 to exert a force at the second bracket connection 234 to cause the bracket 198 and associated blade 152 to rotate in a counterclockwise direction, that is, to the right.

In this way, when utilizing double acting actuators 244, 246, the forces exerted by the power links 236, 238 on the bracket connections 232, 234, respectively, combine to cause the bracket 198 to pivot in a clockwise direction. It will be appreciated, however, that in an alternate embodiment, single acting hydraulic actuators could be utilized to provide the pivoting action. In operating the hydraulic components, any appropriate hydraulic and control arrangement may be utilized.

Figure 7:
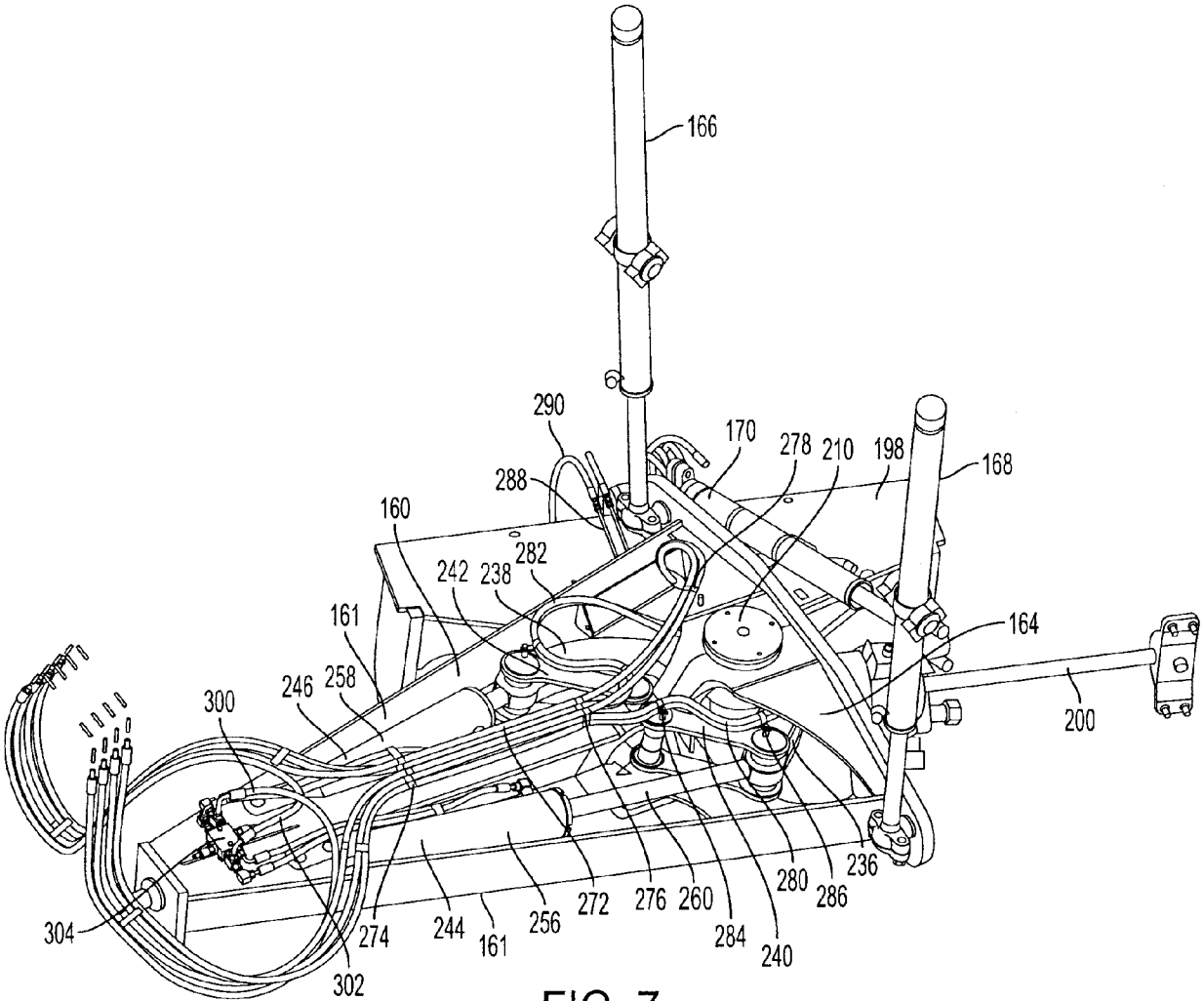
FIG. 7 is an enlarged, fragmentary isometric view of the linkage assembly, showing an exemplary routing of hydraulic hoses.
Figure 8:
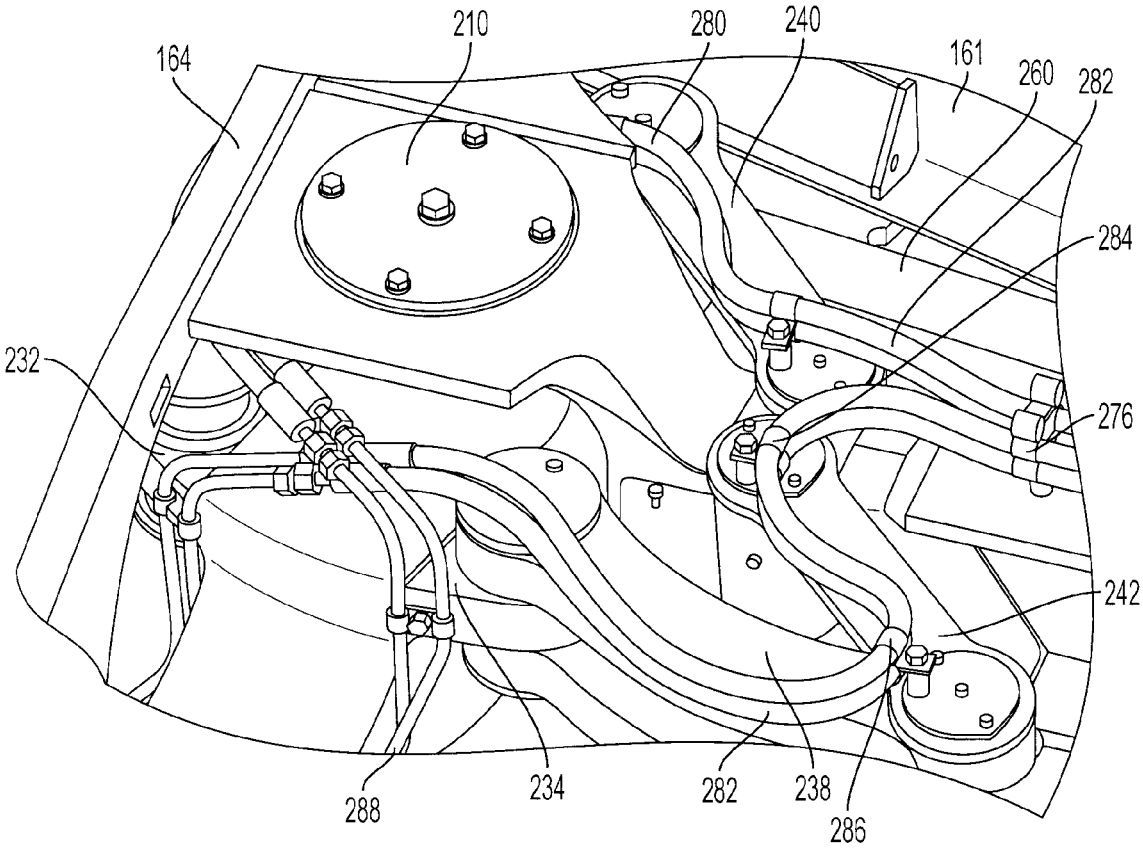
FIG. 8 is a further enlarged fragmentary view of the linkage assembly in the position shown in FIG. 7, a portion of the of the yolk having been broken away.
Figure 9:
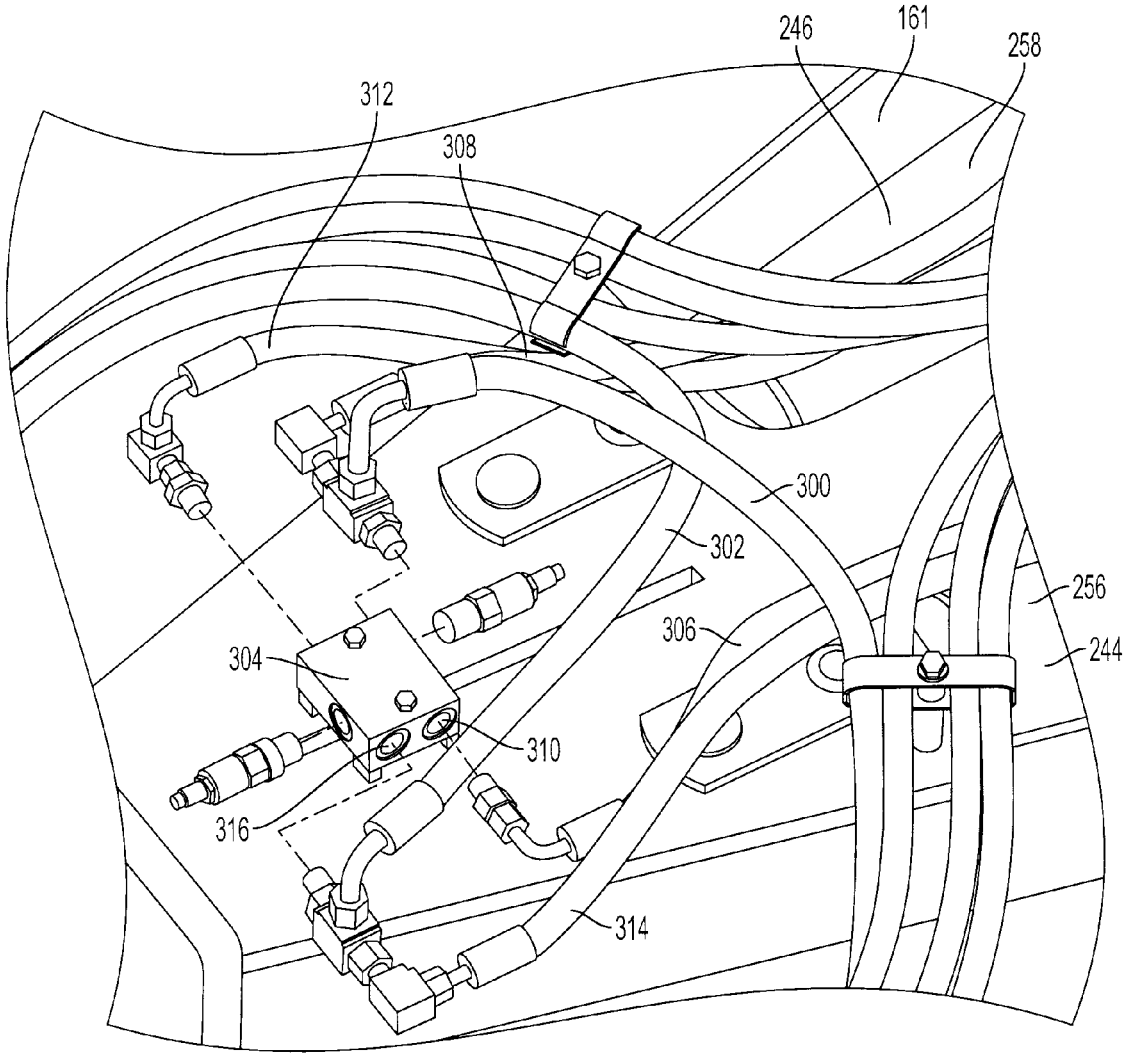
FIG. 9 is a further enlarged fragmentary view of a portion of the linkage assembly of FIG. 7.

FIGS. 7-9 show an exemplary arrangement of a plurality of hydraulic hoses and/or tubes to provide selective flow of hydraulic fluid for operation of the various actuators 170, 200, 204, 244, 246 of the linkage arrangement 230. In order to minimize opportunities for the linkage arrangement 230 to interfere with the hydraulic hoses, the hydraulic hoses may be routed along various components of the linkage assembly 154. For example, as shown in FIG. 7, hydraulic hoses 272 may extend along and be coupled to the drawbar 161 by appropriate mounting clips 274, 276 or the like. Inasmuch as the center shift actuator 170 is coupled directly to the yolk 164, minimal movement is required of the hoses 272, which may be clipped to and around the yolk 164 by clips 278 at appropriate positions along the yolk 164 to route the hoses 272 to the center shift actuator 170.

In sharp contrast, the hoses 280, 282 for operation of the side shift actuator 200 and the blade tip actuator 202 must accommodate the considerable relative motion between the bracket 198 and the yolk 164. To minimize the opportunity for the hoses 280, 282 to wear against, or become entangled with or pinched by the various components associated with this movement, the hoses 280, 282 may be disposed generally along the idler links 240, 242 and the power links 236, 238. In the illustrated arrangement, clips 284, 286 are provided at the joints at opposite ends of the idler links 240, 242, and along the first and second bracket connections 232, 234 (see FIG. 8). In this way, the hoses 280, 282 are constrained to follow the general movements of the idler and power links 240, 242, 236, 238, minimizing or eliminating opportunities for pinching or other damage to the hoses 280, 282. In an alternate embodiment, the clips 284, 286 may be alternatively disposed, so long as the hoses 280, 282 are adequately restrained to deter damage. Further, by routing the hoses 280, 282 along the top of each other, the hoses 280, 282 exhibit the same bending radii, again, minimizing the opportunities for misalignment or possible damage.

In order to accommodate close tolerances, the hoses may be strictly confined, or replaced by more durable tubes 288 along areas where no bending is required, such as, for example, between the yolk 164 and the upper surface of the bracket 198. It will be appreciated that this placement of the tubes 288 minimizes the opportunity for wear as a result of the repeated relative movement between the bracket 198 and the yolk 164. As may be seen in FIG. 7, the tubes 288 may again be coupled to hoses 290 where more flexibility is required, that is, as the hoses 290 extend from the upper surface of the bracket 198 to the side shift actuator 200 and the blade tip actuator 202.

Turning now to FIG. 9 and the hydraulic connections for the actuators 244, 246, of the linkage arrangement 230, hoses 300, 302 provide hydraulic fluid for operation of the actuators 244, 246. Free flow of fluid is provided between the first section 256 of the first hydraulic cylinder 244 and the second section 262 of the second hydraulic cylinder 246, and free flow is provided between the first section 258 of the second hydraulic cylinder 246 and the second section 260 of the first hydraulic cylinder 244 by way of a manifold 304. More specifically, hose 306 and hose 308 connect the first section 256 of the first hydraulic cylinder 244 and the second section 262 of the second hydraulic cylinder 246 with a first open channel 310, respectively, within the manifold 304. Similarly, hose 312 and hose 314 connect the first section 258 of the second hydraulic cylinder 246 and the second section 260 of the first hydraulic cylinder 244 with a second open channel 316, respectively, within the manifold 304. Hose 300 is fluidly connected with the first open channel 310 within the manifold 304, while hose 302 is fluidly connected with the second open channel 316 within the manifold 304.

In this way, as fluid is provided, for example, from a source of pressurized fluid (not shown) through the hose 300 to the first open channel 310 in the manifold 304, fluid flows to the first section 256 of the first hydraulic cylinder 244 and the second section 262 of the second hydraulic cylinder 246 through hoses 306, 308, respectively. At the same time, fluid from the first section 258 of the second hydraulic cylinder 246 and the second section 260 of the first hydraulic cylinder 244 flows through hoses 312, 314 to the second open channel 316 of the manifold 304, and back through hose 302. As a result, the first hydraulic cylinder 244 retracts, and the second hydraulic cylinder 246 extends to turn the blade 152 to the left.

Conversely, as fluid is provided from a source of pressurized fluid (not shown) through the hose 302 to the second open channel 316 in the manifold 304, fluid flows to the first section 258 of the second hydraulic cylinder 246 and the second section 260 of the first hydraulic cylinder 244 through hoses 312, 314, respectively. At the same time, fluid from the first section 256 of the first hydraulic cylinder 244 and the second section 262 of the second hydraulic cylinder 246 flows through hoses 306, 308 to the first open channel 310 of the manifold 304, and back through hose 300. As a result, the second hydraulic cylinder 246 retracts, and the first hydraulic cylinder 244 extends to turn the blade 152 to the right.

The individual motors, pumps, sump, etc., have not been illustrated for the sake of brevity. It will be appreciated that any appropriate arrangement may be provided in this regard. within the spirit of this disclosure.

INDUSTRIAL APPLICABILITY

The present disclosure is applicable to the mounting of a blade 152 to a motor grader. 101. Some embodiments of the linkage assembly 154 may alleviate the need for any or all of a hydraulic motor, and/or a worm gear drive and ring gear, and/or the baseline linkage with opposing hydraulic actuators utilized in connection with the rotation of the blade 152 about the articulation axis 212. Accordingly, some embodiments of the disclosure may provide an associated cost savings.

In some embodiments, fully enclosed pin joints may replace sliding wear strips. Some embodiments may provide maintenance benefits, including reductions, eliminations, and/or simplifications of such maintenance.

Some embodiments may provide advantageous manufacturing and assembly of components. Some embodiments may be packaged with minimal or no interference problems.

In some embodiments, hydraulic hoses may be routed to the linkage assembly 154 without the use of a hydraulic swivel. In some embodiments, the mounting arrangement may allow the mounting bracket to pivot at least ±65 degrees. In some embodiments, the mounting arrangement may allow the mounting bracket to pivot at least substantially ±75 degrees.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A mounting arrangement for coupling an implement to a mobile machine, the machine having a longitudinally extending mainframe having a rear frame portion and a front frame portion, the rear frame portion being supported on a plurality of rear ground-engaging members, the front frame portion extending forwardly from the rear frame portion and being at least partially supported on at least one front ground engaging member, the mounting arrangement comprising a rigid drawbar assembly having a rearward end and a forward end, the drawbar assembly including a generally V-shaped drawbar and a yoke, the drawbar having a narrowed end and a broadened end, the narrowed end being disposed toward the forward end of the drawbar assembly, the yoke being disposed across and secured with the broadened end to prevent relative movement between the yoke and the drawbar at the broadened end, the narrowed end of the drawbar being adapted to be universally coupled to the front frame portion proximal to the at least one front ground engaging member, the rearward end of the drawbar assembly being adapted to be coupled to the front frame portion a distance from the at least one front ground engaging member, a mounting bracket pivotably coupled relative to the drawbar assembly and defining an articulation axis that is substantially perpendicular to the drawbar assembly, the mounting bracket including first and second bracket connections spaced from said articulation axis, the mounting bracket adapted to be coupled to the implement to pivotably couple the implement relative to the drawbar assembly, first and second idler links, each idler link having first and second ends, the first end of each idler link being pivotably coupled to the drawbar assembly, first and second power links, each power link having first and second ends, the first ends of the power links being pivotably coupled to the mounting bracket at the first and second spaced bracket connections, and first and second hydraulic actuators having first and second sections adapted to telescope between extended and retracted positions, the first section of each hydraulic actuator being coupled to the drawbar assembly, and the second section of the first hydraulic actuator being pivotably coupled to the second end of the first power link and the second end of the first idler link, the second section of the second hydraulic actuator being pivotably coupled to the second end of the second power link and the second end of the second idler link.

2. The mounting arrangement of claim 1 wherein the first and second sections of each hydraulic actuator include a cylinder and telescoping rod, the cylinder being coupled to the drawbar assembly, and the rod being coupled to one of the first and second idler links, and one of the first and second power links.

3. The mounting arrangement of claim 1 wherein at least one of the mounting bracket and the drawbar assembly includes at least one casting, said casting at least partially defining the articulation axis.

4. The mounting arrangement of claim 1 wherein the mounting bracket pivots at least ±65 degrees.

5. The mounting arrangement of claim 4 wherein the mounting bracket pivots at least substantially ±75 degrees.

6. The mounting arrangement of claim 1 further including a plurality of hydraulic hoses, at least a portion of the hydraulic hoses being routed along the drawbar assembly.

7. The mounting arrangement of claim 6 wherein at least a portion of the hydraulic hoses are routed along at least one of the first idler link, the second idler link, the first power link, and the second power link.

8. A mobile machine adapted to support an implement, the machine comprising a mainframe having a rear frame portion and a front frame portion, the front frame portion being elongated and extending forwardly from the rear frame portion, a plurality of rear ground-engaging members, the rear frame portion being supported on the plurality of rear ground-engaging members, at least one front ground-engaging member, the front frame portion being at least partially supported on the front ground engaging member, a rigid drawbar assembly disposed below a portion of the front frame portion and having a rearward end and a forward end, the drawbar assembly including a generally V-shaped drawbar and a yoke, the drawbar having a narrowed end and a broadened end, the narrowed end being disposed toward the forward end of the drawbar assembly, the yoke being disposed across and secured with the broadened end to prevent relative movement between the yoke and the drawbar at the broadened end, the narrowed end of the drawbar being universally coupled to the front frame portion proximal to the at least one front ground engaging member, the rearward end of the drawbar assembly being coupled to the front frame portion a distance from the at least one front ground engaging member, a mounting bracket pivotably coupled relative to the drawbar assembly and defining an articulation axis that is substantially perpendicular to the drawbar assembly, the mounting bracket including first and second bracket connections spaced from said articulation axis, the mounting bracket adapted to be coupled to the implement to pivotably couple the implement relative to the drawbar assembly, first and second idler links, each idler link having first and second ends, the first end of each idler link being pivotably coupled to the drawbar assembly, first and second power links, each power link having first and second ends, the first ends of the power links being pivotably coupled to the mounting bracket at first and second spaced bracket connections, and first and second hydraulic actuators having first and second sections adapted to telescope between extended and retracted positions, the first section of each hydraulic actuator being coupled to the drawbar assembly, and the second section of the first hydraulic actuator being pivotably coupled to the second end of the first power link and the second end of the first idler link, the second section of the second hydraulic actuator being pivotably coupled to the second end of the second power link and the second end of the second idler link.

9. The machine of claim 8 further including a hinge pivotably coupling the front and rear frame portions.

10. The machine of claim 8 wherein the front and rear frame portions are at least one of secured together or formed as a single mainframe unit.

11. The machine of claim 8 wherein the implement is a blade.

12. The machine of claim 8 wherein the first and second sections of each hydraulic actuator include a cylinder and telescoping rod, the cylinder being coupled to the drawbar assembly, and the rod being coupled to one of the first and second idler links, and one of the first and second power links.

13. The machine of claim 8 wherein at least one of the mounting bracket and the drawbar assembly includes at least one casting, said casting at least partially defining the articulation axis.

14. The machine of claim 8 wherein the mounting bracket pivots at least ±65 degrees.

15. The machine of claim 8 further including at least one further hydraulic actuator.

16. The machine of claim 8 further including a plurality of hydraulic hoses, at least a portion of the hydraulic hoses being routed along the drawbar assembly.

17. The machine of claim 16 wherein at least a portion of the hydraulic hoses are routed along at least one of the first idler link, the second idler link, the first power link, and the second power link.

18. A motor grader adapted to support a blade, the motor grader comprising a mainframe having a rear frame portion and a front frame portion, the front frame portion being elongated and extending forwardly from the rear frame portion, a plurality of rear ground-engaging members, the rear frame portion being supported on the plurality of rear ground-engaging members, at least one front ground-engaging member, the front frame portion being at least partially supported on the front ground engaging member, a rigid drawbar assembly disposed below a portion of the front frame portion and having a rearward end and a forward end, the drawbar assembly including a generally V-shaped drawbar and a yoke, the drawbar having a narrowed end and a broadened end, the narrowed end being disposed toward the forward end of the drawbar assembly, the yoke being disposed across and secured with the broadened end to prevent relative movement between the yoke and the drawbar at the broadened end, the narrowed end of the drawbar being universally coupled to the front frame portion proximal to the at least one front ground engaging member, the rearward end of the drawbar assembly being coupled to the front frame portion a distance from the at least one front ground engaging member, a mounting bracket pivotably coupled relative to the drawbar assembly and defining an articulation axis that is substantially perpendicular to the drawbar assembly, and first and second spaced bracket connections, said spaced bracket connections being disposed on opposite sides of a plane including the articulation axis, the mounting bracket adapted to be coupled to the blade to pivotably couple the blade relative to the drawbar assembly, first and second idler links, each idler link having first and second ends, the first end of each idler link being pivotably coupled to the drawbar assembly, first and second power links, each power link having first and second ends, the first ends of the power links being pivotably coupled to the mounting bracket at said first and second spaced bracket connections, and first and second double acting hydraulic actuators having first and second sections adapted to telescope between extended and retracted positions, the first section of each hydraulic actuator being coupled to the drawbar assembly, and the second section of the first hydraulic actuator being pivotably coupled to the second end of the first power link and the second end of the first idler link, the second section of the second hydraulic actuator being pivotably coupled to the second end of the second power link and the second end of the second idler link.

19. The motor grader of claim 18 wherein the first and second sections of each hydraulic actuator include a cylinder and telescoping rod, the cylinder being coupled to the drawbar assembly, and the rod being coupled to one of the first and second idler links, and one of the first and second power links.

20. The motor grader of claim 18 further including a plurality of hydraulic hoses, at least a portion of the hydraulic hoses being routed along the drawbar assembly and along at least one of the first idler link, the second idler link, the first power link, and the second power link.

* * * * *